US010280866B2

(12) United States Patent
Oyori et al.

(10) Patent No.: US 10,280,866 B2
(45) Date of Patent: May 7, 2019

(54) FLUID SUPPLY DEVICE

(71) Applicant: IHI AEROSPACE CO., LTD., Tokyo (JP)

(72) Inventors: Hitoshi Oyori, Tokyo (JP); Noriko Morioka, Tokyo (JP)

(73) Assignee: IHI AEROSPACE CO., LTD., Tokyo (JP)

( * ) Notice: Subject to any disclaimer, the term of this patent is extended or adjusted under 35 U.S.C. 154(b) by 201 days.

(21) Appl. No.: 15/487,321

(22) Filed: Apr. 13, 2017

(65) Prior Publication Data

US 2017/0218875 A1 Aug. 3, 2017

Related U.S. Application Data

(62) Division of application No. 13/870,898, filed on Apr. 25, 2013, now abandoned.

(30) Foreign Application Priority Data

Apr. 26, 2012 (JP) ..... 2012-101012

(51) Int. Cl.
*F04C 14/02* (2006.01)
*F04C 14/08* (2006.01)
(Continued)

(52) U.S. Cl.
CPC ..... *F02D 41/3082* (2013.01); *F02D 41/3845* (2013.01); *F02M 37/18* (2013.01);
(Continued)

(58) Field of Classification Search
CPC ..... F04B 49/065; F04B 49/06; F04B 49/20; F04B 11/0058; F04B 2205/09;
(Continued)

(56) References Cited

U.S. PATENT DOCUMENTS 3,011,308 A * 12/1961 Wotring ..... F02C 7/236 239/124
3,060,858 A * 10/1962 Shoosmith ..... F04C 14/02 417/15

(Continued)

FOREIGN PATENT DOCUMENTS

JP 2007-113433 A 5/2007
JP 2010-261379 A 11/2010

OTHER PUBLICATIONS

Non-Final Office Action issued in U.S. Appl. No. 13/870,898, dated Mar. 14, 2016.

(Continued)

*Primary Examiner* — Nathan C Zollinger
(74) *Attorney, Agent, or Firm* — Marshall, Gerstein & Borun LLP

(57) ABSTRACT

A fuel supply device according to the present invention comprises a first fuel pump for forcing fuel from a fuel tank to a fuel passage, a first electric motor for driving the first fuel pump, a second fuel pump for forcing fuel from the fuel tank to the fuel passage, a second electric motor for driving the second fuel pump, a supply flow rate sensor for detecting flow rate in the supply passage, and a control device for controlling the flow rate in the supply passage to follow a desired value thereof, by regulating rotational speeds of the first and second electric motors depending on a difference between the desired value and a detected value of flow rate in the supply passage.

3 Claims, 4 Drawing Sheets

(51) Int. Cl.

| | |
|---|---|
| ***F04B 49/20*** | (2006.01) |
| ***F04B 49/06*** | (2006.01) |
| ***F02M 37/18*** | (2006.01) |
| ***F02D 41/38*** | (2006.01) |
| ***F02D 41/30*** | (2006.01) |
| *F02M 37/00* | (2006.01) |

(52) U.S. Cl.
CPC ..... *F04B 49/06* (2013.01); *F04B 49/20* (2013.01); *F02M 37/00* (2013.01); *F04B 2205/09* (2013.01); *F04B 2207/041* (2013.01); *F04C 14/02* (2013.01); *F04C 14/08* (2013.01)

(58) Field of Classification Search
CPC ..... F04B 2207/041; Y10T 137/86163; F04D 15/029; F02M 63/027; F02M 37/08; F02M 37/18; F02M 37/00; F02D 41/3082; F02D 41/3845; F04C 14/02; F04C 14/08
USPC ..... 417/2, 3, 4, 5, 6, 43
See application file for complete search history.

(56) References Cited

U.S. PATENT DOCUMENTS 3,589,836 A * 6/1971 Danker ..... F02M 37/18 417/203
5,259,731 A * 11/1993 Dhindsa ..... F04B 49/065 417/3
5,566,709 A * 10/1996 Fujii ..... F04B 49/03 137/487.5
6,516,249 B1 * 2/2003 Hoyle ..... F04B 49/065 417/286
6,732,017 B2 * 5/2004 Pham ..... G05D 11/132 700/265
7,010,393 B2 * 3/2006 Mirsky ..... F04D 15/0022 417/1
7,578,173 B2 8/2009 Weissgerber
7,942,649 B2 * 5/2011 Lesther ..... F04C 11/001 417/248
8,951,019 B2 * 2/2015 Hains ..... F02C 7/22 137/563
2011/0031272 A1 * 2/2011 Comiskey ..... G01F 3/10 222/23
2011/0050793 A1 * 3/2011 Kumagai ..... B41J 2/125 347/22
2011/0189028 A1 * 8/2011 Shampine ..... F04B 49/06 417/53

OTHER PUBLICATIONS

Non-Final Office Action issued in U.S. Appl. No. 13/870,898, dated Jun. 22, 2016.
Final Office Action issued in U.S. Appl. No. 13/870,898, dated Jan. 13, 2017.

* cited by examiner

FLUID SUPPLY DEVICE

BACKGROUND OF THE INVENTION

Field of the Invention

The present invention relates to a fluid supply device for supplying fluid from a fluid reservoir to a supply passage.

Description of the Related Art

As an example of the fluid supply device for supplying fluid from a fluid reservoir to a fluid passage, a fuel supply device for supplying fuel to an engine of an automobile, an aircraft or the like is a known, wherein a pump driven by the engine accessory gearbox forces fuel from a fuel tank into the engine. The flow rate of fuel delivered by the pump therefore depends on the rotational speed of the engine, and thus, the fuel supply device of this type comprises a regulation valve, a bypass valve and the like to control the flow rate of fuel supplied to the engine (see JP 2008-530442 A).

The fuel supply device with a pump driven by the engine accessory gearbox can continue supplying fuel to the engine as long as the engine is rotating, which is advantageous in terms of reliability. The fuel supply device of this type, however, has a disadvantage that it is large in size because of a regulation valve, a bypass valve and the like required to control the flow rate of fuel supplied to the engine.

In recent years, to deal with this problem, there have been proposed fuel supply devices for aircraft with a pump driven by an electric motor, in place of the engine accessory gearbox as in the conventional devices. The fuel supply device of this type is able to control the flow rate of fuel by regulating the rotational speed of the electric motor, and thus, does not require a regulation valve, a bypass valve or the like, which leads to advantages such as a reduced size and cost. The fuel supply device with a pump driven by an electric motor has, however, a problem in terms of reliability, since failure of the electric motor, malfunction in the electrical system or the like may lead to interruption of fuel supply to the engine.

As a means to solve this problem, a redundant-configuration multiphase motor having, for example two sets of phase windings is known (see JP 2002-369586 A). With the fuel supply device with a pump driven by an electric motor of this type, at least the possibility that the failure of the electric motor leads to interruption of fuel supply to the engine is reduced.

However, even with the fuel supply device with a pump driven by a redundant-configuration multiphase motor, failure of the pump may lead to interruption of fuel supply to the engine. This is the same with the fuel supply device with a pump driven by the engine accessory gearbox.

SUMMARY OF THE INVENTION

An aspect of the present invention is directed to a fluid supply device comprising a first constant displacement pump for forcing fluid from a fluid reservoir to a supply passage, a first electric motor for driving the first constant displacement pump, a second constant displacement pump for forcing fluid from the reservoir to the supply passage, a second electric motor for driving the second constant displacement pump, a flow rate detection device for detecting flow rate in the supply passage, and a control device for controlling the flow rate in the supply passage to follow a desired value thereof, by regulating rotational speeds of the first and second electric motors depending on a difference between the desired value and a detected value of flow rate in the supply passage.

The constant displacement pump driven by the rotating motor displaces a constant amount of fluid per revolution of the motor, and thus, delivers fluid at a flow rate substantially proportional to the rotational speed of the motor. Fluid thus flows in the supply passage at a flow rate determined by the flow rates at which the first and second constant displacement pumps deliver it, respectively. Thus, by detecting the flow rate in the supply passage with the flow rate detection device and regulating the rotational speeds of the first and second electric motors depending on a difference between a desired value and a detected value of flow rate in the supply passage, the flow rate in the supply passage is feedback-controlled to follow the desired value.

Under the feedback control, the flow rate of fluid in the supply passage is automatically maintained at the desired value, even when one of the electric motors or one of the constant displacement pumps fails. Specifically, if one of the constant displacement pumps delivers fluid at a decreased flow rate due to some failure, the rotational speed of the electric motor driving the other constant displacement pump is automatically increased, so that the constant displacement pump delivers fluid at an increased flow rate, so that the flow rate in the supply passage is maintained at the desired value. Even if one of the constant displacement pumps ceases to deliver fluid due to some failure, the rotational speed of the electric motor driving the other constant displacement pump is automatically increased so that it will deliver fluid at a flow rate increased to achieve the desired value in the supply passage. The flow rate in the supply passage is thus maintained at the desired value.

The present invention thus provides a fluid supply device with improved reliability.

The above-described fluid supply device according to the present invention is designed to control the flow rate of fluid by regulating the rotational speeds of the electric motors, and thus, does not require a regulation valve, a bypass valve or the like. Devices, such as a device for detecting failure of the electric motors and the constant displacement pumps or a device for changing the route of fluid flow, are not required, either. The flow rate in the supply passage is maintained at a desired value only by simple feedback control, which allows a reduction in size and cost of the fluid supply device.

Another aspect of the present invention is directed to a fluid supply device comprising a first constant displacement pump for forcing fluid from a fluid reservoir to a first supply passage, a first electric motor for driving the first constant displacement pump, a second constant displacement pump for forcing fluid from the reservoir to a second supply passage, a second electric motor for driving the second constant displacement pump, a third constant displacement pump for forcing fluid from the reservoir to the first and second supply passages, a third electric motor for driving the third constant displacement pump, a flow rate detection device for detecting flow rates in the first and second supply passages, respectively, and a control device for controlling the flow rates in the first and second supply passages to follow their respective desired values, by regulating rotational speeds of the first, second and third electric motors depending on a difference between the desired value and a detected value of flow rate in the first supply passage and a difference between the desired value and a detected value of flow rate in the second supply passage.

Fluid flows in the first supply passage at a flow rate determined by the flow rates at which the first and third constant displacement pumps deliver it, respectively. Thus, by detecting the flow rate in the first supply passage with the flow rate detection device and regulating the rotational speeds of the first and third electric motors depending on a difference between a desired value and a detected value of flow rate in the first supply passage, the flow rate in the first supply passage is feedback-controlled to follow the desired value.

Likewise, fluid flows in the second supply passage at a flow rate determined by the flow rates at which the second and third constant displacement pumps deliver it, respectively. Thus, by detecting the flow rate in the second supply passage with the flow rate detection device and regulating the rotational speeds of the second and third electric motors depending on a difference between a desired value and a detected value of flow rate in the second supply passage, the flow rate in the second supply passage is feedback-controlled to follow the desired value.

Under the feedback control, the flow rates of fluid in the first and second supply passages are automatically maintained at their respective desired values, even when one of the electric motors or one of the constant displacement pumps fails. Specifically, if one of the constant displacement pumps delivers fluid at a decreased flow rate due to some failure, the rotational speed of the electric motor driving another constant displacement pump is automatically increased, so that the constant displacement pump delivers fluid at an increased flow rate, so that the flow rates in the first and second supply passages are maintained at their respective desired values. Even if one of the constant displacement pumps ceases to deliver fluid due to some failure, the rotational speed of the electric motor driving another constant displacement pump is automatically increased so that it will deliver fluid at a flow rate increased to achieve the desired value in the relevant supply passage. The flow rates in the first and second supply passages are thus maintained at their respective desired values.

The present invention thus provides a fluid supply device with improved reliability.

The above-described fluid supply device according to the present invention is designed to control the flow rate of fluid by regulating the rotational speeds of the electric motors, and thus, does not require a regulation valve, a bypass valve or the like. Devices, such as a device for detecting failure of the electric motors and the constant displacement pumps or a device for changing the route of fluid flow, are not required, either. The flow rates in the first and second supply passages are maintained at their respective desired values only by simple feedback control, which allows a reduction in size and cost of the fluid supply device.

The above-described fluid supply device has a feature that the third and first constant displacement pumps complement each other to maintain the desired flow rate in the first supply passage, while the third and second constant displacement pumps complement each other to maintain the desired flow rate in the second supply passage. This feature enables a great reduction in size and cost of the fluid supply device while keeping high reliability.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE INVENTION

With reference to the drawings attached, embodiments of the present invention will be described below.

First Embodiment

Figure 1:
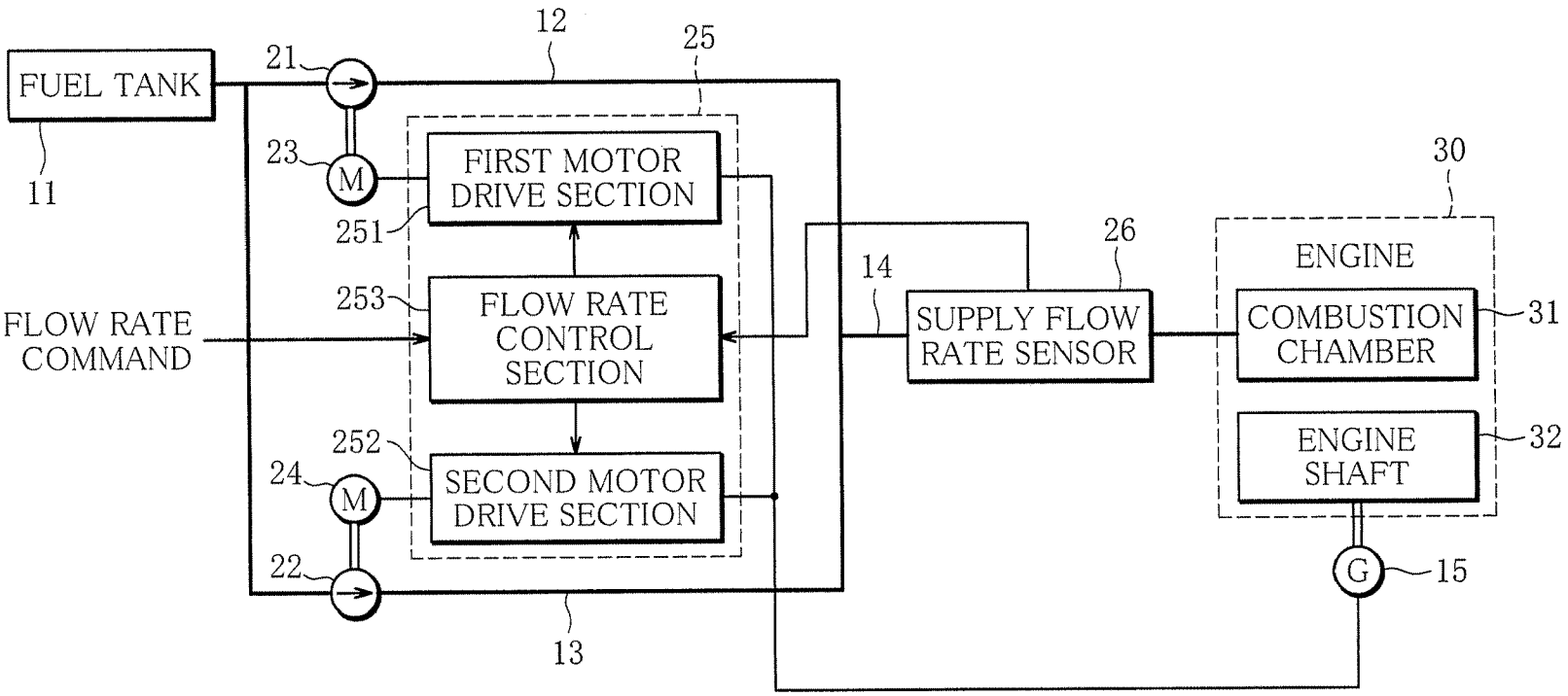
FIG. 1 is a block diagram showing the configuration of a first embodiment of a fuel supply device.

With reference to FIG. 1, a first embodiment of a fluid supply device, specifically, fuel supply device according to the present invention will be described.

FIG. 1 is a block diagram showing the configuration of the first embodiment of the fuel supply device.

The first embodiment of the fuel supply device comprises a fuel tank 11, a first fuel passage 12, a second fuel passage 13, a supply passage 14, an electric generator 15, a first fuel pump 21, a second fuel pump 22, a first electric motor 23, a second electric motor 24, a control device 25 and a supply flow rate sensor 26.

The fuel tank 11, which is a "reservoir", holds fuel, which is "fluid". To the fuel tank 11, the first and second fuel passages 12, 13 are connected. The first and second fuel passages 12, 13 are connected to the supply passage 14 at the other end. The supply passage 14 is connected to a combustion chamber 31 of an engine 30. The engine 30 is an internal combustion engine operating by burning fuel supplied from the fuel tank 11 to the combustion chamber 31. The electric generator 15 generates electricity by power being transmitted from a rotating engine shaft 32 of the engine 30.

The first fuel pump 21, which is a "first constant displacement pump", is fitted to the first fuel passage 12 to force fuel from the fuel tank 11 to the supply passage 14. The first fuel pump 21 is driven by the rotating first electric motor 23. The first fuel pump 21, which is a known constant displacement gear pump or constant displacement vane pump, for example, is a constant displacement pump which displaces a constant amount of fuel per revolution of the first electric motor 23, and thus, delivers fuel at a flow rate substantially proportional to the rotational speed of the first electric motor 23. The first electric motor 23 is a three-phase AC motor, for example.

The second fuel pump 22, which is a "second constant displacement pump", is fitted to the second fuel passage 13 to force fuel from the fuel tank 11 to the supply passage 14. The second fuel pump 22 is driven by the rotating second electric motor 24. The second fuel pump 22, which is a known constant displacement gear pump or constant displacement vane pump, for example, as is the case with the first fuel pump 21, is a constant displacement pump which displaces a constant amount of fuel per revolution of the second electric motor 24, and thus, delivers fuel at a flow rate substantially proportional to the rotational speed of the second electric motor 24. The second electric motor 24 is a three-phase AC motor, for example, as is the case with the first electric motor 23.

The supply flow rate sensor 26, which is a "flow rate detection device", is a sensor detecting the flow rate of fuel in the supply passage 14. The output signal of the supply flow rate sensor 26 is transmitted to the control device 25.

The control device 25 regulates the respective rotational speeds of the first and second electric motors 23, 24 on the basis of a flow rate command transmitted from an external source and the fuel flow rate detected by the supply flow rate sensor 26. The control device 25 includes a first motor drive section 251, a second motor drive section 252 and a flow rate control section 253.

The first motor drive section 251 drives the first electric motor 23 with power from the electric generator 15. The second motor drive section 252 drives the second electric motor 24 with power from the electric generator 15. The first and second motor drive sections 251, 252 are each a motor control circuit including, for example a converter (not shown) for changing AC generated by the electric generator 15 to DC, and an inverter (not shown) for changing the DC generated by the converter to AC. The converter is, for example a known electric power converting circuit including a rectifier circuit, a chopper circuit, and a chopper circuit driver, and changing AC to DC at a desired voltage. The inverter is, for example a known electric power converting circuit including a semiconductor switch and a semiconductor switch drive circuit, and changing DC to AC at a desired voltage and frequency.

The first and second motor drive sections 251 251 control their associated motors by known PWM (pulse-width modulation), for example. The flow rate control section 253 is a feedback control circuit which controls the flow rate in the supply passage 14 to follow a desired value (flow rate command) by regulating the rotational speeds of the first and second electric motors 23, 24 depending on a difference between the desired value and a detected value of flow rate in the supply passage 14. To achieve high accuracy of flow rate control, the flow rate control section 253 desirably performs known PI (proportional integral) or PID (proportional integral derivative) control, for example.

In the first embodiment of the fuel supply device configured as described, the first fuel pump 21 displaces a constant amount of fuel per revolution of the first electric motor 23, and thus, delivers fuel at a flow rate substantially proportional to the rotational speed of the first electric motor 23, and the second fuel pump 22 displaces a constant amount of fuel per revolution of the second electric motor 24, and thus, delivers fuel at a flow rate substantially proportional to the rotational speed of the second electric motor 24. Fuel thus flows in the supply passage 14 at a flow rate determined by the flow rates at which the first and second fuel pumps 21, 22 deliver it, respectively. Thus, by detecting the flow rate in the supply passage 14 with the supply flow rate sensor 26 and regulating the rotational speeds of the first and second electric motors 23, 24 depending on a difference between a desired value and a detected value of flow rate in the supply passage 14, the flow rate in the supply passage 14 is feedback-controlled to follow the desired value.

Even if the first fuel pump 21 or the second fuel pump 22 fails or the first electric motor 23 or the second electric motor 24 fails, the flow rate of fuel in the supply passage 14 is automatically maintained at the desired value under the feedback control by the flow rate control section 253. If the first fuel pump 21 delivers fuel at a decreased flow rate due to some failure, for example, the rotational speed of the second electric motor 24 is automatically increased, so that the second fuel pump 22 delivers fuel at an increased flow rate, so that the flow rate in the supply passage 14 is maintained at the desired value. Likewise, if the second fuel pump 22 delivers fuel at a decreased flow rate due to some failure, the rotational speed of the first electric motor 23 is automatically increased, so that the first fuel pump 21 delivers fuel at an increased flow rate, so that the flow rate in the supply passage 14 is maintained at the desired value.

Even if the first fuel pump 21 ceases to deliver fuel due to some failure, the rotational speed of the second electric motor 24 is automatically increased so that the second fuel pump 22 will deliver fuel at a flow rate increased to achieve the desired flow rate in the supply passage 14. The flow rate in the supply passage 14 is thus maintained at the desired value. Likewise, even if the second fuel pump 22 ceases to deliver fuel due to some failure, the rotational speed of the first electric motor 23 is automatically increased so that the first fuel pump 21 will deliver fuel at a flow rate increased to achieve the desired flow rate in the supply passage 14. The flow rate in the supply passage 14 is thus maintained at the desired value.

The first embodiment of the fuel supply device according to the present invention has thus improved reliability. The first embodiment of the fuel supply device is designed to control the flow rate of fuel in the supply passage 14 by regulating the rotational speeds of the first and second electric motors 23, 24, and thus, does not require a regulation valve, a bypass valve or the like. Devices, such as a device for detecting failure of the first and second fuel pumps 21, 22 and the first and second electric motors 23, 24 or a device for changing the route of fuel flow between the first and the second fuel passages 12, 13, are not required, either. The flow rate in the supply passage 14 is automatically maintained at the desired value only by simple feedback control, which allows a reduction in size and cost of the fluid supply device.

Second Embodiment

Figure 2:
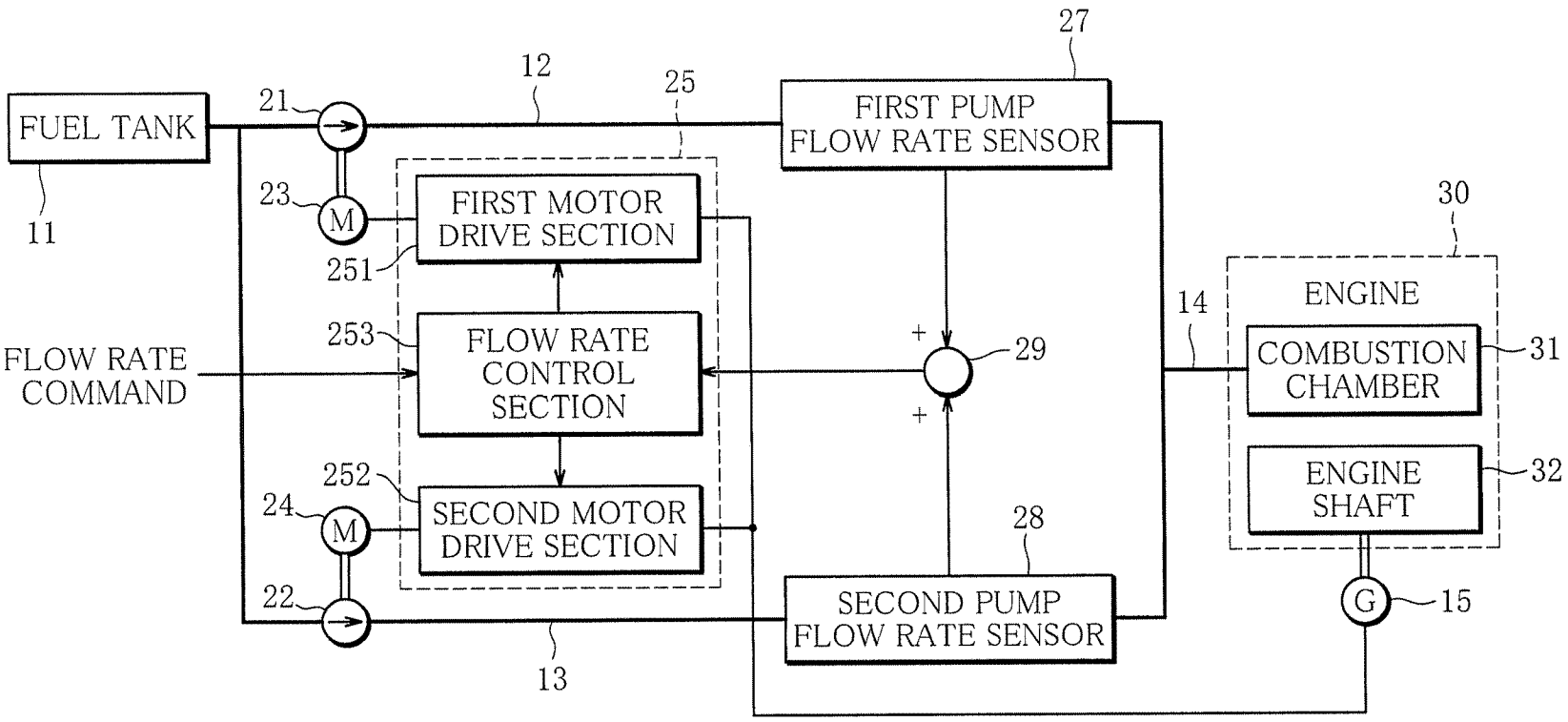
FIG. 2 is a block diagram showing the configuration of a second embodiment thereof.

With reference to FIG. 2, a second embodiment of the fluid supply device, specifically, fuel supply device according to the present invention will be described.

FIG. 2 is a block diagram showing the configuration of the second embodiment of the fuel supply device.

The second embodiment of the fuel supply device differs from the first embodiment in that it comprises a first pump flow rate sensor 27, a second pump flow rate sensor 28 and an adder 29 in place of the supply flow sensor 26 of the first embodiment; both embodiments are similar in the other respects. In the following description of the second embodiment, the differences from the first embodiment will be described in detail while the same components as those of the first embodiment, indicated by the same reference characters, will not.

In the second embodiment, the "flow rate detection device" comprises a first pump flow rate sensor 27, a second pump flow rate sensor 28 and an adder 29. The first pump flow rate sensor 27 detects the flow rate at which the first fuel pump 21 delivers fuel, or in other words, flow rate of fuel in the first fuel passage 12, while the second pump flow rate sensor 28 detects the flow rate at which the second fuel pump 22 delivers fuel, or in other words, flow rate of fuel in the second fuel passage 13. The adder 29 transmits to the flow rate control section 253 a signal informing of the sum of flow rate values detected by the first and second pump flow rate sensors 27, 28.

The present invention can be carried out in this mode, in which case it has the same advantageous effects as the first embodiment. The second embodiment of the fuel supply device has an advantage that it is able to detect the flow rates at which the first and second fuel pump 21, 22 deliver fuel, individually, and thus, detect that the first or second fuel pump 21, 22 ceases to deliver fuel or delivers fuel at a decreased flow rate due to some failure, individually.

Third Embodiment

Figure 3:
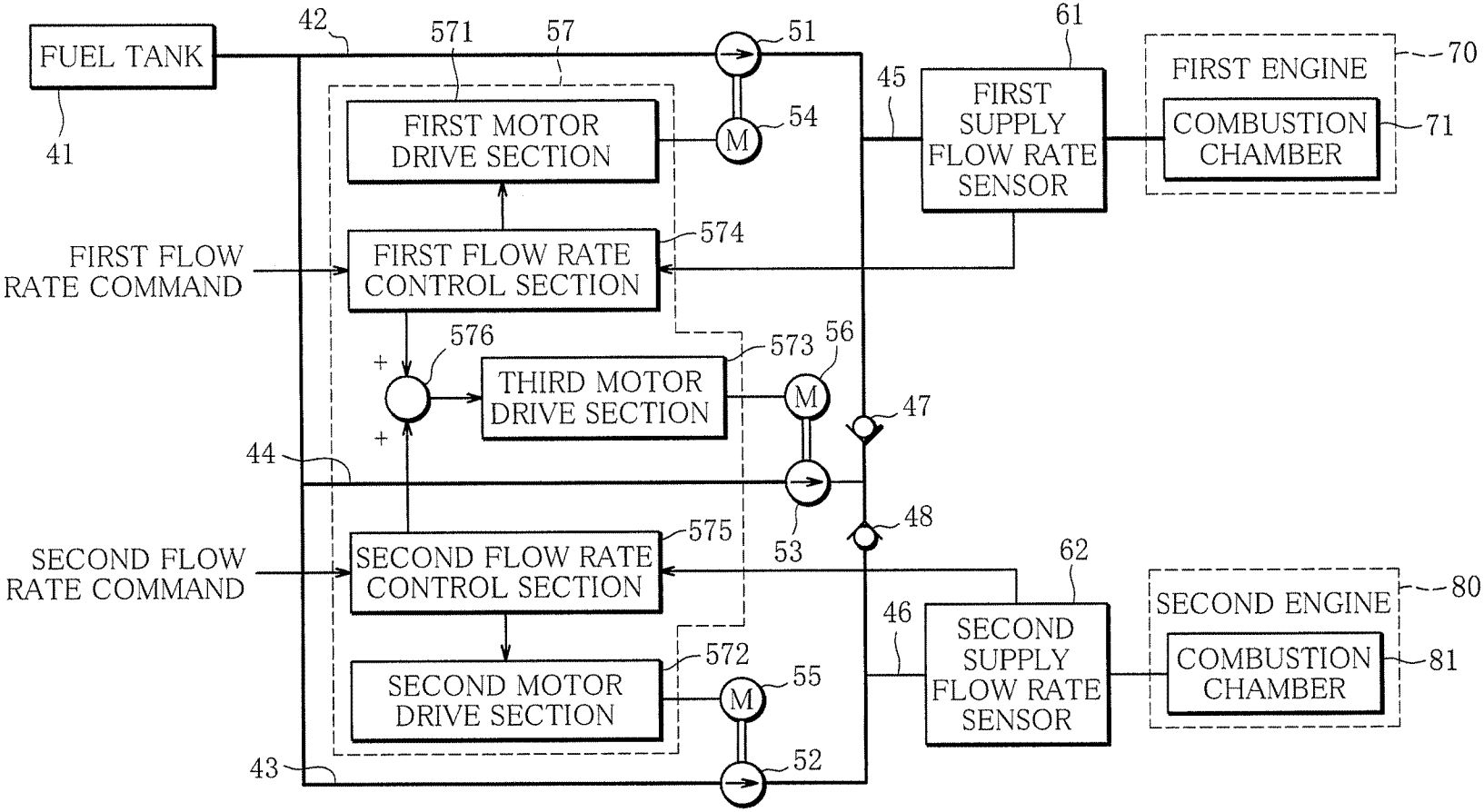
FIG. 3 is a block diagram showing the configuration of a third embodiment thereof.

With reference to FIG. 3, a third embodiment of the fluid supply device, specifically, fuel supply device according to the present invention will be described.

FIG. 3 is a block diagram showing the configuration of the third embodiment of the fuel supply device.

The third embodiment of the fuel supply device comprises a fuel tank 41, a first fuel passage 42, a second fuel passage 43, a third fuel passage 44, a first supply passage 45, a second supply passage 46, a first check valve 47 and a second check valve 48.

The fuel tank 41, which is a "reservoir", holds fuel, which is "fluid". To the fuel tank 41, the first, second and third fuel passage 42, 43, 44 are connected. The first fuel passage 42 is connected to the first supply passage 45, the second fuel passage 43 to the second supply passage 46, and the third fuel passage 44 to both the first and second supply passages 45, 46. The first check valve 47 is fitted to a passage between the third fuel passage 44 and the first supply passage 45 to prevent fuel from flowing from the first fuel passage 42 to the second supply passage 46. The second check valve 48 is fitted to a passage between the third fuel passage 44 and the second supply passage 46 to prevent fuel from flowing from the second fuel passage 43 to the first supply passage 45.

The first supply passage 45 is connected to a combustion chamber 71 of a first engine 70. The first engine 70 is an internal combustion engine operating by burning fuel supplied from the fuel tank 41 to the combustion chamber 71. The second supply passage 46 is connected to a combustion chamber 81 of a second engine 80. The second engine 80 is an internal combustion engine operating by burning fuel supplied from the fuel tank 41 to the combustion chamber 81.

The third embodiment of the fuel supply device further comprises a first fuel pump 51, a second fuel pump 52, a third fuel pump 53, a first electric motor 54, a second electric motor 55, a third electric motor 56, a control device 57, a first supply flow rate sensor 61 and a second supply flow rate sensor 62.

The first fuel pump 51, which is a "first constant displacement pump", is fitted to the first fuel passage 42 to force fuel from the fuel tank 41 to the first supply passage 45. The first fuel pump 51 is driven by the rotating first electric motor 54. The first fuel pump 51, which is a known constant displacement gear pump or constant displacement vane pump, for example, is a constant displacement pump which displaces a constant amount of fuel per revolution of the first electric motor 54, and thus, delivers fuel at a flow rate substantially proportional to the rotational speed of the first electric motor 54. The first electric motor 54 is a three-phase AC motor, for example.

The second fuel pump 52, which is a "second constant displacement pump", is fitted to the second fuel passage 43 to force fuel from the fuel tank 41 to the second supply passage 46. The second fuel pump 52 is driven by the rotating second electric motor 55. The second fuel pump 52, which is a known constant displacement gear pump or constant displacement vane pump, for example, as is the case with the first fuel pump 51, is a constant displacement pump which displaces a constant amount of fuel per revolution of the second electric motor 55, and thus, delivers fuel at a flow rate substantially proportional to the rotational speed of the second electric motor 55. The second electric motor 55 is a three-phase AC motor, for example, as is the case with the first electric motor 54.

The third fuel pump 53, which is a "third constant displacement pump", is fitted to the third fuel passage 44 to force fuel from the fuel tank 41 to the first and second supply passages 45, 46. The third fuel pump 53 is driven by the rotating third electric motor 56. The third fuel pump 53, which is a known constant displacement gear pump or constant displacement vane pump, for example, as is the case with the first fuel pump 51, is a constant displacement pump which displaces a constant amount of fuel per revolution of the third electric motor 56, and thus, delivers fuel at a flow rate substantially proportional to the rotational speed of the third electric motor 56. The third electric motor 56 is a three-phase AC motor, for example, as is the case with the first electric motor 54.

The first supply flow rate sensor 26, which is a "flow rate detection device", is a sensor detecting the flow rate of fuel in the first supply passage 45. The second supply flow rate sensor 62, which is a "flow rate detection device", is a sensor detecting the flow rate of fuel in the second supply passage 46. The output signals of the first and second supply flow rate sensor 61, 62 are transmitted to the control device 57.

The control device 57 regulates the respective rotational speeds of the first, second and third electric motors 54, 55, 56 on the basis of a first and a second flow rate commands transmitted from an external source and the fuel flow rates detected by the first and second supply flow rate sensor 61, 62. More specifically, the control device 57 controls the flow rates in the first and second supply passages 45, 46 to follow their respective desired values (first and second flow rate commands) by regulating the rotational speeds of the first, second and third electric motors 54, 55, 56 depending on a difference between the desired value and a detected value of flow rate in the first supply passage 45 and a difference between the desired value and a detected value of flow rate in the second supply passage 46.

The control device 57 comprises a first motor drive section 571, a second motor drive section 572, a third motor drive section 573, a first flow rate control section 574, a second flow rate control section 575 and an adder 576.

The first, second and third motor drive sections 571, 572, 753 drive the first, second and third electric motors 54, 55, 56, respectively. The first, second and third motor drive sections 571, 572, 753 are each a motor control circuit including a converter (not shown) for changing AC to DC, and an inverter (not shown) for changing the DC generated by the converter to AC. The first, second and third motor drive sections 571, 572, 573 control their associated motors by known PWM, for example, as is the case with the first embodiment.

The first flow rate control section 574 is a feedback control circuit which controls the flow rate in the first supply passage 45 to follow a desired value thereof by regulating the rotational speeds of the first and third electric motors 54, 56 depending on a difference between the desired value of flow rate in the first supply passage 45 and a value detected by the first supply flow rate sensor 61. The second flow rate control section 575 is a feedback control circuit which controls the flow rate in the second supply passage 46 to follow a desired value thereof by regulating the rotational speeds of the second and third electric motors 55, 56 depending on a difference between the desired value of flow rate in the second supply passage 46 and a value detected by the second supply flow rate sensor 62. The adder 576 sums a value of control signal (difference between a desired value and a detected value of flow rate in the first supply passage 45) transmitted from the first flow rate control section 574 and a value of control signal (difference between a desired value and a detected value of flow rate in the second supply passage 46) transmitted from the second flow rate control section 575, and transmits the resulting value to the third motor drive section 573. To achieve high accuracy of flow rate control, the first and second flow rate control sections 574, 575 desirably perform known PI (proportional integral) or PID (proportional integral derivative) control, for example.

In the third embodiment of the fuel supply device configured as described above, fuel flows in the first supply passage 45 at a flow rate determined by the flow rates at which the first and second fuel pumps 51, 53 deliver it, respectively. Thus, by detecting the flow rate in the first supply passage 45 with the first supply flow rate sensor 61 and regulating the rotational speeds of the first and third electric motors 54, 56 depending on a difference between a desired value and a detected value of flow rate in the first supply passage 45, the flow rate in the first supply passage 45 is feedback-controlled to follow the desired value.

Similarly, fuel flows in the second supply passage 46 at a flow rate determined by the flow rates at which the second and third fuel pumps 52, 53 deliver it, respectively. Thus, by detecting the flow rate in the second supply passage 46 with the second supply flow rate sensor 62 and regulating the rotational speeds of the second and third electric motors 55, 56 depending on a difference between a desired value and a detected value of flow rate in the second supply passage 46, the flow rate in the second supply passage 46 is feedback-controlled to follow the desired value.

Even if the first fuel pump 51 or the third fuel pump 53 fails or the first electric motor 54 or the third electric motor 56 fails, the flow rate of fuel in the first supply passage 45 is automatically maintained at the desired value under the feedback control by the first flow rate control section 574. Likewise, if the second fuel pump 52 or the third fuel pump 53 fails or the second electric motor 55 or the third electric motor 56 fails, the flow rate of fuel in the second supply passage 46 is automatically maintained at the desired value under the feedback control by the second flow rate control section 575.

If the first fuel pump 51 delivers fuel at a decreased flow rate due to some failure, for example, the rotational speed of the third electric motor 56 is automatically increased under the feedback control by the first flow rate control section 574, so that the third fuel pump 53 delivers fuel at an increased flow rate, so that the flow rate in the first supply passage 45 is maintained at the desired value. The increase in the flow rate at which the third supply pump 53 delivers fuel leads to an increase in flow rate in the second supply passage 46. Thus, under the feedback control by the second flow rate control section 575, the rotational speed of the second electric motor 55 is automatically decreased, so that the second fuel pump 52 delivers fuel at a decreased flow rate, so that the flow rate in the second supply passage 46 is maintained at the desired value.

If the second fuel pump 52 delivers fuel at a decreased flow rate due to some failure, for example, the rotational speed of the third electric motor 56 is automatically increased under the feedback control by the second flow rate control section 575, so that the third fuel pump 53 delivers fuel at an increased flow rate, so that the flow rate in the second supply passage 46 is maintained at the desired value. The increase in the flow rate at which the third supply pump 53 delivers fuel leads to an increase in flow rate in the first supply passage 45. Thus, under the feedback control by the first flow rate control section 574, the rotational speed of the first electric motor 54 is automatically decreased, so that the first fuel pump 51 delivers fuel at a decreased flow rate, so that the flow rate in the first supply passage 45 is maintained at the desired value.

If the third fuel pump 53 delivers fuel at a decreased flow rate due to some failure, for example, the rotational speeds of the first and second electric motors 54, 55 are automatically increased under the feedback control by the first and second flow rate control sections 574, 575, so that the first and second fuel pumps 51, 52 deliver fuel at an increased flow rate, so that the flow rates in the first and second supply passage 45, 46 are maintained at their respective desired values.

The third embodiment of the fuel supply device according to the present invention has thus improved reliability. Further, the third embodiment of the fuel supply device has a feature that the third and first fuel pumps 53, 51 complement each other to maintain the desired flow rate in the first supply passage 45, while the third and second fuel pumps 53, 52 complement each other to maintain the desired flow rate in the second supply passage 46. This feature enables a great reduction in size and cost of the fuel supply device while keeping high reliability.

Fourth Embodiment With reference to FIG. 4, a fourth embodiment of the fluid supply device, specifically, fuel supply device according to the present invention will be described.

Figure 4:
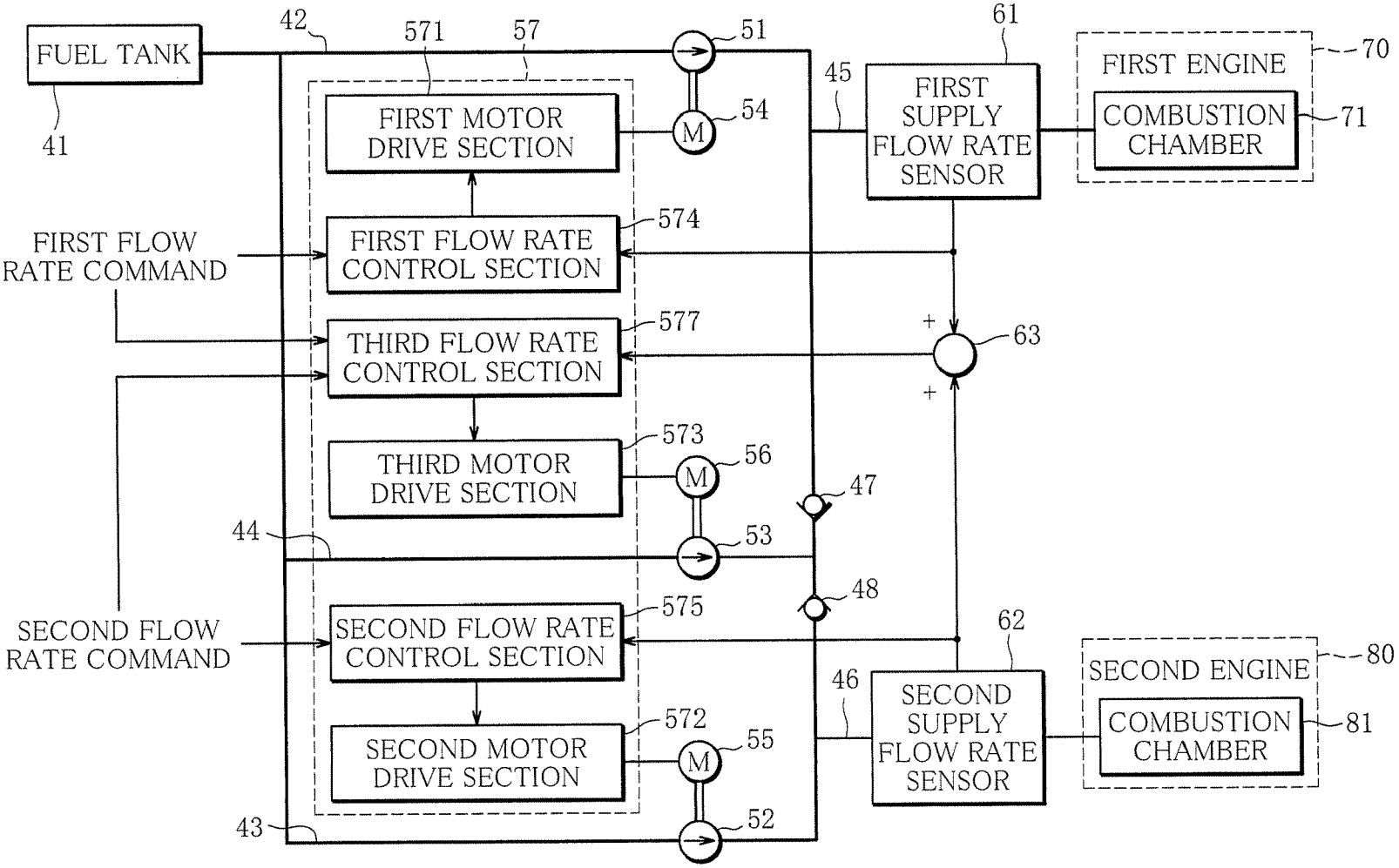
FIG. 4 is a block diagram showing the configuration of a fourth embodiment thereof.

FIG. 4 is a block diagram showing the configuration of the fourth embodiment of the fuel supply device.

The fourth embodiment of the fuel supply device differs from the third embodiment in that it further comprises an adder 63, and that the control device 57 includes a third flow rate control section 577 in place of the adder 576 of the third embodiment. In the following description of the fourth embodiment of the fuel supply device, the differences from the third embodiment will be described in detail while the same components as those of the third embodiment, indicated by the same reference characters, will not.

In the fourth embodiment, the "flow rate detection device" comprises an adder 63 in addition to the first and second supply flow rate sensors 61, 62. The adder 63 transmits to the third flow rate control section 577 a signal informing of the sum of flow rate values detected by the first and second supply flow rate sensors 61, 62.

In the fourth embodiment, the first flow rate control section 574 is a feedback control circuit which controls the flow rate in the first supply passage 45 to follow a desired value thereof by regulating the rotational speed of the first electric motor 54 depending on a difference between the desired value of flow rate in the first supply passage 45 and a value detected by the first supply flow rate sensor 61. The second flow rate control section 575 is a feedback control circuit which controls the flow rate in the second supply passage 46 to follow a desired value thereof by regulating the rotational speed of the second electric motor 55 depending on a difference between the desired value of flow rate in the second supply passage 46 and a value detected by the second supply flow rate sensor 66. The third flow rate control section 577 is a feedback control circuit which controls the sum of the flow rates in the first and second supply passages 45, 46 to follow the sum of their respective desired values by regulating the rotational speed of the third electric motor 56 depending on a difference between the sum of the desired values of flow rate in the first and second supply passages 45, 46 and the sum of values detected by the first and second supply flow rate sensors 61, 62 (value of the output signal of the adder 63). To achieve high accuracy of flow rate control, the first, second and third flow rate control section 574, 575, 577 desirably perform known PI (proportional integral) or PID (proportional integral derivative) control, for example.

In the fourth embodiment of the fuel supply device configured as described above, even if the first fuel pump 51 or the third fuel pump 53 fails or the first electric motor 54 or the third electric motor 56 fails, the flow rate of fuel in the first supply passage 45 is automatically maintained at the desired value under the feedback control by the first and third flow rate control sections 574, 577. Likewise, even if the second fuel pump 52 or the third fuel pump 53 fails or the second electric motor 55 or the third electric motor 56 fails, the flow rate of fuel in the second supply passage 46 is automatically maintained at the desired value under the feedback control by the second and third flow rate control sections 575, 577.

If the first fuel pump 51 delivers fuel at a decreased flow rate due to some failure, for example, the rotational speed of the third electric motor 56 is automatically increased under the feedback control by the third flow rate control section 577, so that the third fuel pump 53 delivers fuel at an increased flow rate, so that the flow rate in the first supply passage 45 is maintained at the desired value. The increase in the flow rate at which the third fuel pump 53 delivers fuel leads to an increase in flow rate in the second supply passage 46. Thus, under the feedback control by the second flow rate control section 575, the rotational speed of the second electric motor 55 is automatically decreased, so that the second fuel pump 52 delivers fuel at a decreased flow rate, so that the flow rate in the second supply passage 46 is maintained at the desired value.

If the second fuel pump 52 delivers fuel at a decreased flow rate due to some failure, for example, the rotational speed of the third electric motor 56 is automatically increased under the feedback control by the third flow rate control section 577, so that the third fuel pump 53 delivers fuel at an increased flow rate, so that the flow rate in the second supply passage 46 is maintained at the desired value. The increase in the flow rate at which the third fuel pump 53 delivers fuel leads to an increase in flow rate in the first supply passage 45. Thus, under the feedback control by the first flow rate control section 574, the rotational speed of the first electric motor 54 is automatically decreased, so that the first fuel pump 51 delivers fuel at a decreased flow rate, so that the flow rate in the first supply passage 45 is maintained at the desired value.

If the third fuel pump 53 delivers fuel at a decreased flow rate due to some failure, for example, the rotational speeds of the first and second electric motors 54, 55 are automatically increased under the feedback control by the first and second flow rate control sections 574, 575, so that the first and second fuel pumps 51, 52 deliver fuel at an increased flow rate, so that the flow rates in the first and second supply passages 45, 46 are maintained at their respective desired values.

The present invention can be carried out in this mode, in which case it has the same advantageous effects as the third embodiment.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fluid supply device, comprising:

a first constant displacement pump for forcing fluid from a fluid reservoir to a first supply passage, a first electric motor for driving the first constant displacement pump, a second constant displacement pump for forcing fluid from the reservoir to a second supply passage, a second electric motor for driving the second constant displacement pump, a third constant displacement pump for forcing fluid from the reservoir to the first and second supply passages, a third electric motor for driving the third constant displacement pump, a flow rate detection device for detecting flow rates in the first and second supply passages, respectively, and a control device for controlling the flow rates in the first and second supply passages to follow their respective desired values, by regulating rotational speeds of the first, second and third electric motors depending on a difference between the desired value and a detected value of flow rate in the first supply passage and a difference between the desired value and a detected value of flow rate in the second supply passage.

2. The fluid supply device according to claim 1, wherein the flow rate detection device includes a first supply flow rate sensor for detecting the flow rate in the first supply passage and a second supply flow rate sensor for detecting the flow rate in the second supply passage, and the control device includes a first flow rate control section for controlling the flow rate in the first supply passage to follow a desired value thereof, by regulating the rotational speeds of the first and third electric motors depending on a difference between the desired value of flow rate in the first supply passage and a value detected by the first supply flow rate sensor, and a second flow rate control section for controlling the flow rate in the second supply passage to follow a desired value thereof, by regulating the rotational speeds of the second and third electric motors depending on a difference between the desired value of flow rate in the second supply passage and a value detected by the second supply flow rate sensor.

3. The fluid supply device according to claim 1, wherein the flow rate detection device includes a first supply flow rate sensor for detecting the flow rate in the first supply passage and a second supply flow rate sensor for detecting the flow rate in the second supply passage, and the control device includes:

a first flow rate control section for controlling the flow rate in the first supply passage to follow a desired value thereof, by regulating the rotational speed of the first electric motor depending on a difference between the desired value of flow rate in the first supply passage and a value detected by the first supply flow rate sensor, a second flow rate control section for controlling the flow rate in the second supply passage to follow a desired value thereof, by regulating the rotational speed of the second electric motor depending on a difference between the desired value of flow rate in the second supply passage and a value detected by the second supply flow sensor, and a third flow rate control section for controlling the sum of the flow rates in the first and the second supply passages to follow the sum of their respective desired values, by regulating the rotational speed of the third electric motor depending on a difference between the sum of the desired values of flow rate in the first and the second supply passages and the sum of values detected by the first and second supply flow sensors, respectively.

* * * * *